US005371528A

United States Patent [19]

Izumida et al.

[11] Patent Number: 5,371,528

[45] Date of Patent: Dec. 6, 1994

[54] LIQUID JET HEAD WITH NONLINEAR LIQUID PASSAGES HAVING A DEVERGING PORTION

[75] Inventors: Masaaki Izumida, Kawasaki; Koichi Sato, Yokohama; Shigeaki Tanaka, Kawasaki; Tsuguhiro Fukuda, Yokohama; Nobuyuki Kuwabara, Tokyo; Akira Goto; Takashi Watanabe, both of Yokohama; Kunihiko Maeoka, Kawasaki; Hiroshi Sugitani, Machida; Yoshifumi Hattori, Yamato; Masami Ikeda, Tokyo; Asao Saito, Yokohama; Kazuaki Masuda, Sagamihara; Akio Saito, Hadano; Tsuyoshi Orikasa, Kasukabe, all of Japan

[73] Assignee: Canon Kabushiki Kaisha, Tokyo, Japan

[21] Appl. No.: 911,112

[22] Filed: Jul. 9, 1992

Related U.S. Application Data

[63] Continuation of Ser. No. 583,167, Sep. 17, 1990, Pat. No. 5,148,192.

[30] Foreign Application Priority Data

Sep. 18, 1989 [JP] Japan ..... 1-241049
Sep. 18, 1989 [JP] Japan ..... 1-241050

[51] Int. Cl.[5] ..... B41J 2/05

[52] U.S. Cl. ..... 347/87

[58] Field of Search ..... 346/140 R, 1.1, 75; 400/126; 29/890.1

[56] References Cited

U.S. PATENT DOCUMENTS

| | | | |
|---|---|---|---|
| 4,158,847 | 6/1979 | Heinzl et al. | 346/140 R |
| 4,209,794 | 6/1980 | Kattner | 346/140 R |
| 4,313,124 | 1/1982 | Hara | 346/140 R |
| 4,330,787 | 5/1982 | Sato et al. | 346/140 R |
| 4,345,262 | 8/1982 | Shirato et al. | 346/140 R |
| 4,394,670 | 7/1983 | Sugitani et al. | 346/140 R |
| 4,412,224 | 10/1983 | Sugitani | 346/1.1 |
| 4,450,455 | 5/1984 | Sugitani et al. | 346/140 R |
| 4,459,600 | 7/1984 | Sato et al. | 346/140 R |
| 4,463,359 | 7/1984 | Ayata et al. | 346/1.1 |
| 4,521,787 | 6/1985 | Yokota et al. | 346/140 R |
| 4,558,333 | 12/1985 | Sugitani et al. | 346/140 R |
| 4,567,493 | 1/1986 | Ikeda et al. | 346/140 R |
| 4,587,534 | 5/1986 | Saito et al. | 346/140 R |
| 4,646,110 | 2/1987 | Ikeda et al. | 346/140 R |
| 4,723,129 | 2/1988 | Endo et al. | 346/1.1 |
| 4,740,796 | 4/1988 | Endo et al. | 346/1.1 |
| 4,894,667 | 1/1990 | Moriyama | 346/140 R |
| 5,059,973 | 10/1991 | Watanabe | 346/1.1 |

FOREIGN PATENT DOCUMENTS

| | | |
|---|---|---|
| 0347856 | 12/1989 | European Pat. Off. . |
| 54-056847 | 5/1979 | Japan . |
| 55-059975 | 5/1980 | Japan . |
| 55-059976 | 5/1980 | Japan . |
| 55-059977 | 5/1980 | Japan . |
| 58-197058 | 11/1983 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A liquid jet head includes a heat generating element for producing a bubble to eject liquid from the head, a heat acting zone in which heat generated by the heat generating element produces a bubble in the liquid, a liquid supply passage adjacent the heat acting zone and having a liquid supply opening, with a center, for supplying liquid to the heat acting zone, and a liquid ejection passage adjacent the heat acting zone and having an orifice, with a center, through which the liquid is ejected, the liquid ejection passage including a diverging portion extending in a direction from the heat acting zone toward the orifice. A first plane that includes a first center line passing through the center of the orifice and along a direction of liquid ejection through the orifice, and a second plane that includes a second center line passing through the center of the liquid supply opening and along a direction of the supply of liquid from the liquid supply passage to the heat acting zone, cross in the diverging portion of the liquid ejection passage. At least a portion of the liquid supply passage and at least a portion of the diverging portion have a common, collinear surface substantially parallel to the second center line.

13 Claims, 8 Drawing Sheets

LIQUID JET WITH NONLINEAR LIQUID PASSAGES HAVING A DEVERGING PORTION

This application is a continuation of application Ser. No. 07/583,167 filed Sep. 17, 1990, now U.S. Pat. No. 5,148,192.

FIELD OF THE INVENTION AND RELATED ART

The present invention relates to a liquid jet recording head and a liquid jet recording apparatus having the same, more particularly to such a recording head or recording apparatus wherein the liquid passage structure is improved for the printing quality.

Known liquid jet recording machines include a type of machine wherein mechanical deformation of a piezoelectric element is used to produce pressure change in a liquid passage by volumetric change thereof to eject the liquid through an orifice ejection outlet at an end of the passage, a machine of a type wherein electrodes are disposed in front of the outlet orifice to deflect the direction of the movement of the droplet ejected through the orifice, and a machine of a type wherein a heat generating element is disposed in the passage to instantaneously form a bubble to eject the liquid through the outlets. The last type using thermal energy is particularly noted because the recording density can be easily increased, because mass-production is easy and because the manufacturing cost is not high. This results from the features that liquid jet recording outlet such as orifices or the like for ejecting the recording liquid (ink) droplets can be arranged at a high density so that a high resolution printing is possible, that the entire size of the recording head can be easily reduced, that the semiconductor manufacturing technology (IC) and/or a microprocessing technique which are remarkably improved recently in the reliability can be used to good advantages, and that it is easy to manufacture an elongated head or two-dimensional head.

Japanese Laid-Open Patent Application Nos. 59975/1980, 59976/1980 and 59977/1980 and U.S. Pat. No. 4,330,787 have made a proposal for the purpose of improving ejection efficiency, ejection response properties, ejection stability, long periods of continuous printing and high speed recording or the like. However, the recent demand for high speed and high resolution with further stability has required further improvement. More particularly, further improvement is desired in the ejection efficiency, higher speed liquid ejection and higher stability.

Referring first to FIG. 1, there is shown an example of a conventional liquid jet recording head for ejecting the liquid using thermal energy.

The liquid jet recording head 100 shown in FIG. 1 has the liquid passage structure including a liquid passage 101, a thermal actuation portion 102 and a liquid ejection passage 103 in the order named along the flow of the liquid.

The thermal actuation portion 102 is provided with a thermal energy generating element 104 in the form of a heat generating resistor. The heat generating element 104 receives a drive signal, in response to which the heat is produced instantaneously to instantaneously heat the liquid adjacent the heat generating element 104 in the heat actuation portion 102 so as to produce film boiling. The force produced thereupon is effective to eject the liquid through the orifice 105 formed at an end of the liquid ejection passage 103, the ejected liquid is deposited on the surface of the recording material such as paper, so that the recording is effected thereon.

The supply of the required amount of the liquid to the thermal actuation portion 102 is effected through the liquid supply passage 101 using a capillary force or another proper means.

The portion in front of the liquid ejecting portion 103 is gradually converged toward the orifice 105 from the inside to provide a converged space 106. Because of this internal structure, the direction and the speed of the liquid ejected through the orifice 105 are made proper.

In the recording head 100 of FIG. 1, the converged passage 106 is provided by mounting to the end of the passage an orifice member 107 having an aperture with a taper provided by proper means.

In the case of the recording head 100 of FIG. 1, the center lines of the liquid supply passage 101, the thermal actuation portion 102 and the rear portion 108 of the liquid ejection portion 103 are coaxial, as indicated by a reference numeral 109 in this Figure, and in addition the central axis 109 penetrates through the center of the orifice 105.

However, the conventional structure involves the problem of production of satellite droplets which leads to degrading of the printing quality.

FIGS. 2A, 2B and 2C illustrate the mechanism of production of the satellite droplets, although some exaggeration is contained for the easy understanding of the mechanism. When a driving signal is applied to the heat generating element 203 such as a heater, a bubble 204 is produced in the liquid passage filled with the liquid ink, as shown in FIG. 2A. By the ejection force resulting therefrom, the main droplet 205 is ejected through the orifice 206. Then, together with the rapid volume reduction of the bubble 204, the ink at the downstream and upstream of the bubble 204 moves in the directions indicated by arrows A and B, as shown in FIG. 2B, the ink moving in the directions indicated by the arrows A and B collides, and an impact is produced when the bubble is extinguished. By the impact, a satellite droplet 206 is produced, as shown in FIG. 2C. The direction of the ejection of the satellite droplet 206 is on the center line. 207 of the liquid passage. Reference numeral 201 designates an orifice member having an orifice 206 formed therein.

The satellite droplets degrade the printing quality for the following reasons. The print pattern is to be formed by the main droplets, and therefore, the satellite droplets disturb the print quality except when they are on the point where the associated main droplet is deposited. As described in conjunction with FIGS. 2A, 2B and 2C, the satellite droplet or droplets are ejected after the main droplet. In addition, the ejection speed of the satellite droplet is different from that of the main droplet because of the difference in the mechanism of the production. Generally speaking, the speed is lower. Since there is a relative movement between the recording head and the material to receive the record, the positions of the main droplet and the satellite droplet are different.

As shown in FIG. 3, when a center line 304 connecting a center of the orifice 302 in the orifice member 301 and a center of the upstream side 303 of the orifice is inclined relative to the center line 306 of the passage 305 (an angle 307), the direction of the main droplet is along the center line 304 of the orifice, but the direction of the satellite droplet ejection is on the center line of the ink passage 305, and therefore, the positions of the main droplet and the satellite droplet are further apart than in the above described case. Actually, it has been confirmed that the delay in the production of the satellite droplet relative to the production of the main droplet and the degradation of the print quality attributable to the delay, become more conspicuous with increase of the printing speed. More particularly, the edge of a printed character or the like becomes blurred, and therefore, the fine images become difficult. In FIG. 3, reference numeral 304 designates a heat generating element.

Because of the recent demand for the high speed printing, the deterioration of the print quality attributable to the satellite droplet or droplets becomes a significant problem.

SUMMARY OF THE INVENTION

Accordingly, it is a principal object of the present invention to provide an ink jet recording head, an ink jet recording unit, an ink jet recording cartridge and an ink jet recording apparatus wherein the improvement has been made in the image quality.

It is another object of the invention to provide such a recording head, unit, cartridge or apparatus wherein the satellite printing (the main portion of a droplet and a satellite portion thereof are shot at different positions on the material on which the recording is to be effected) even at a high speed recording.

It is a further object of the present invention to provide a liquid jet recording head and a liquid jet recording apparatus capable of forming a high speed and high resolution printing.

It is a further object of the present invention to provide a liquid jet recording head and a liquid jet recording apparatus wherein the ejection efficiency of the droplet is remarkably improved, and which are easy to manufacture and are suitable for mass-production. It is a further object of the present invention to provide a liquid jet recording head and a liquid jet recording apparatus which are particularly suitable for a high density multi-orifice type.

It is a further object of the present invention to provide a liquid jet recording head and a liquid jet recording apparatus wherein the production of the satellite is suppressed.

It is a further object of the present invention to provide a liquid jet recording head and a liquid jet recording apparatus wherein the liquid can be ejected at a higher speed.

According to an aspect of the present invention, there is provided a liquid jet recording head or apparatus, comprising: a heat generating element; a heat acting zone in which heat generated by said heat generating means acts on liquid; a liquid feeding passage adjacent to said heat acting zone having a liquid supply opening for supplying liquid to said heat acting zone; a liquid ejection passage adjacent said heat acting zone and having an orifice through which the liquid is ejected; wherein a center line passing through the center of said liquid supply opening along a direction of the liquid supply from said liquid supply passage to said heat acting zone is directly across a wall constituting said liquid ejection passage.

According to another aspect of the present invention, there is provided a liquid jet recording head or apparatus, comprising: a heat generating element; a heat acting zone in which heat generated by said heat generating means acts on liquid; a liquid feeding passage adjacent to said heat acting zone having a liquid supply opening for supplying liquid to said heat acting zone; a liquid ejection passage adjacent said heat acting zone and having an orifice through which the liquid is ejected; wherein a plane including a center line passing through the center of said orifice and along a direction of liquid ejection through said orifice and a plane including a center line passing through the center of said liquid supply opening and along a direction of liquid supply from said liquid supply passage to said heat acting zone, are crossed in said liquid ejection passage.

According to another aspect of the present invention there is provided a liquid jet head including a heat generating element for producing a bubble to eject liquid from the head, a heat acting zone in which heat generated by the heat generating element produces a bubble in the liquid, a liquid supply passage adjacent the heat acting zone and having a liquid supply opening, with a center, for supplying liquid to the heat acting zone, and a liquid ejection passage adjacent the heat acting zone and having an orifice, with a center, through which the liquid is ejected, the liquid ejection passage including a diverging portion extending in a direction from the heat acting zone toward the orifice, wherein a first plane including a first center line passing through the center of the orifice and along a direction of liquid ejection through the orifice, and a second plane including a second center line passing through the center of the liquid supply opening and along a direction of the supply of liquid from the liquid supply passage to the heat acting zone, cross in the diverging portion of the liquid ejection passage, and wherein at least a portion of the liquid supply passage and at least a portion of the diverging portion have a common, collinear surface concentric with the second center line.

According to yet another aspect of the present invention there is provided a liquid jet apparatus including a liquid jet heat comprising a heat generating element for producing a bubble to eject liquid from the head, a heat acting zone in which heat generated by the heat generating element produces a bubble in the liquid, a liquid supply passage adjacent to the heat acting zone having a liquid supply opening, with a center, for supplying liquid to the heat acting zone, and a liquid ejection passage adjacent the heat acting zone and having an orifice, with a center, through which the liquid is ejected, the liquid ejection passage including a diverging portion extending in a direction from the heat acting zone toward the orifice, wherein a first plane including a first center line passing through the center of the orifice and along a direction of liquid ejection through the orifice, and a second plane including a second center line passing through the center of the liquid supply opening and along a direction of the supply of liquid from the liquid supply passage to the heat acting zone, cross in the diverging portion of the liquid ejection passage, and wherein at leas a portion of the liquid supply passage and at least a portion of the diverging portion have a common, collinear surface concentric with the second center line.

According to still another aspect of the present invention there is provided a liquid jet cartridge including a heat generating element for producing a bubble to eject liquid from the cartridge, a heat acting zone in which heat generated by the heat generating element produces a bubble in the liquid, a liquid supply passage adjacent the heat acting zone and having a liquid supply opening, with a center, for supplying liquid to the heat acting zone, and a liquid ejection passage adjacent the heat acting zone and having an orifice, with a center, through which the liquid is ejected, the liquid ejection passage including a diverging portion extending in a direction from the heat acting zone toward the orifice, wherein a first plane including a first center line passing through the center of the orifice and along a direction of liquid ejection through the orifice, and a second plane including a second center line passing through the center of the liquid supply opening and along a direction of the supply of liquid from the liquid supply passage to the heat acting zone, cross in the diverging portion of the liquid ejection passage, and wherein at least a portion of the liquid supply passage and at least a portion of the diverging portion have a common, collinear surface concentric with the second center line.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
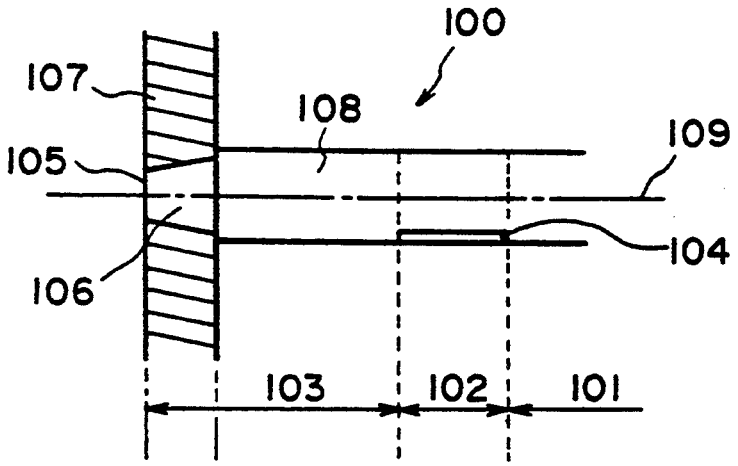
FIG. 1 PRIOR ART
FIG. 1 schematically illustrates a major part of a conventional liquid jet recording head.
Figure 2A:
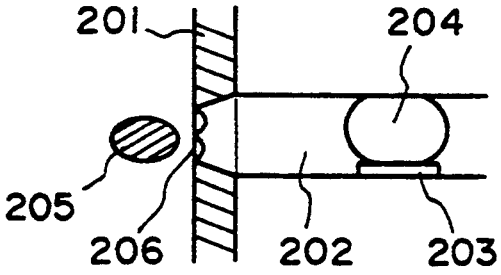
FIG. 2A PRIOR ART
FIGS. 2A, 2B and 2C schematically illustrate an example of a mechanism of satellite production.
Figure 2B:
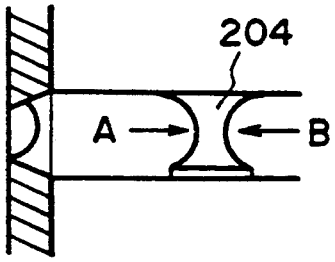
FIG. 2B PRIOR ART
Figure 2C:
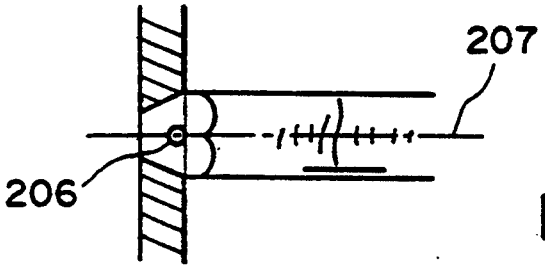
FIG. 2C PRIOR ART
Figure 3:
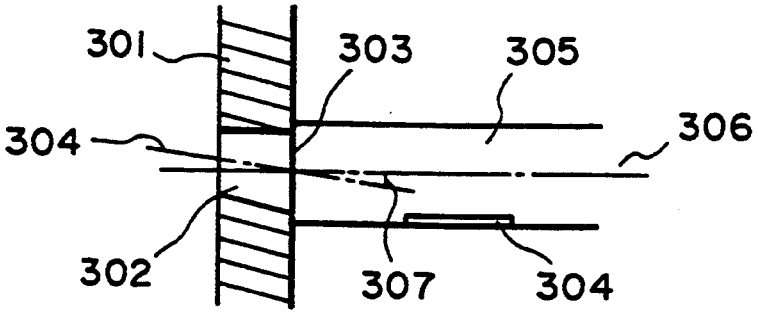
FIG. 3 PRIOR ART
FIG. 3 schematically illustrates the major portion of another conventional liquid jet recording head.
Figure 4:
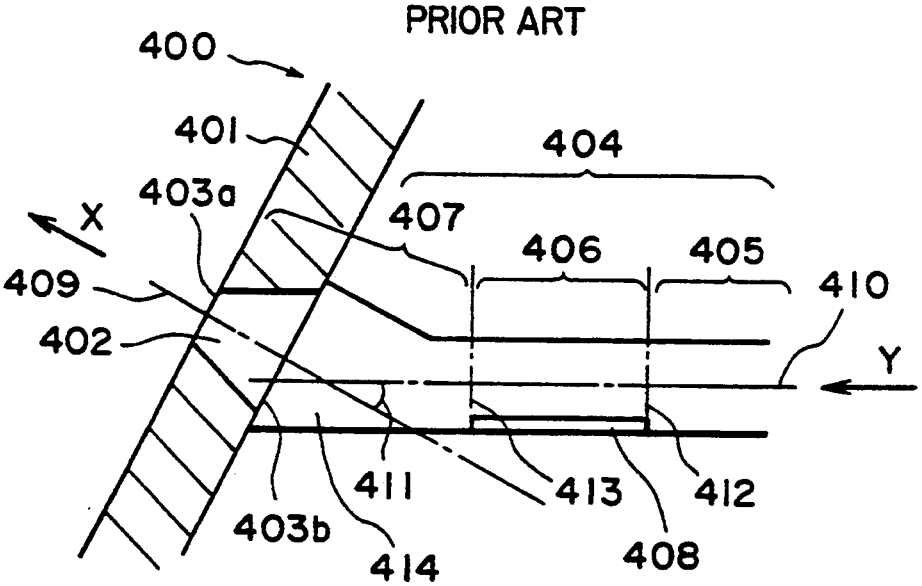
FIG. 4 illustrates the structure of a major portion of a liquid jet recording head according to a first embodiment of the present invention.

Referring to FIG. 4, there is shown a major part of the liquid jet recording head in a cross-section according to an embodiment of the present invention.

Reference numerals 401 and 402 designate an orifice member in the form of a plate and an aperture (ejection outlet) formed in the orifice member 401. The aperture 402 includes a front orifice in one of major surfaces of the orifice 403*a* member 401 and a rear orifice 403*b* in the other one of the major surfaces. The ink passage 404 includes an ink supply passage 405, a thermal actuation portion 406 and an ink ejection passage 407 in the order named along the flow of the ink. The ink passage 404 is mainly constituted by them. The thermal actuation portion 406 is provided with a heat generating element in the form of a heater or the like. Reference numerals 409, 410 and 411 indicate an orifice center line, a passage center line and an angle between the orifice center line 409 and the ink passage center line 410.

The ink supply passage 405 and the thermal actuation portion 406 are connected to each other by a rear opening 412 functioning as an ink supply opening.

The heat actuation portion 406 and the ink ejection passage 407 are connected to each other by a front opening 413. The ink ejection passage 407 includes a rear portion 414 having a diverging space extending from the thermal actuation portion 406.

The aperture 402 constitutes a converging passage from the thermal actuation part 406 side. The orifice center line 409 is the direction of the ejection of the main droplet used for the recording. The orifice center line 409 passes through the center of the front orifice 403*a* and the center of the rear orifice 403*b*. The direction of the main droplet ejection is indicated by an arrow X in FIG. 4. In the liquid jet recording head 400 shown in FIG. 4, a plane including the center line 409 and the plane including the center line 410 are crossed with each other in the rear portion 414. In this embodiment, the center line 410 crosses with an inside surface of the aperture 402. When the driving signal is applied, the heat generating element 408 generates quickly heat, and the liquid on the heat generating element 408 is instantaneously heated, so that a bubble is formed instantaneously on the surface of the heat generating element 408. By the bubble formation, a main droplet is ejected in the direction X. Upon the extinguishing of the bubble formed in the heat actuation portion 406, there is a liability of production of the satellite droplet or droplets. Even if the satellite droplet is produced, it is ejected along the center line 410, and therefore, it is collided on the internal wall of the aperture 402 before it is ejected through the orifice 403*a*, and therefore, is not ejected outside. Therefore, the non-uniform printing attributable to the production of the satellite droplets does not occur on the recording material.

In the liquid jet recording head 400 shown in FIG. 4, the ink liquid supplied to the thermal actuation portion 406 is supplied along the ink supply passage 405 in the direction indicated by an arrow Y. The direction Y is codirectional with the center line 410.

The center line 410 passes through the center of the rear opening 412. From the standpoint of improving the ejection efficiency and from the increase of the ejection speed of the main droplet, the area of the rear orifice 403*b* is preferably equal to or smaller than the maximum opening-area of the rear part 414.

The heat generating element 408 is preferably a planar type from the standpoint of improving the ejection efficiency by providing smooth liquid flow path to stably provide main droplets having uniform size.

Figure 5:
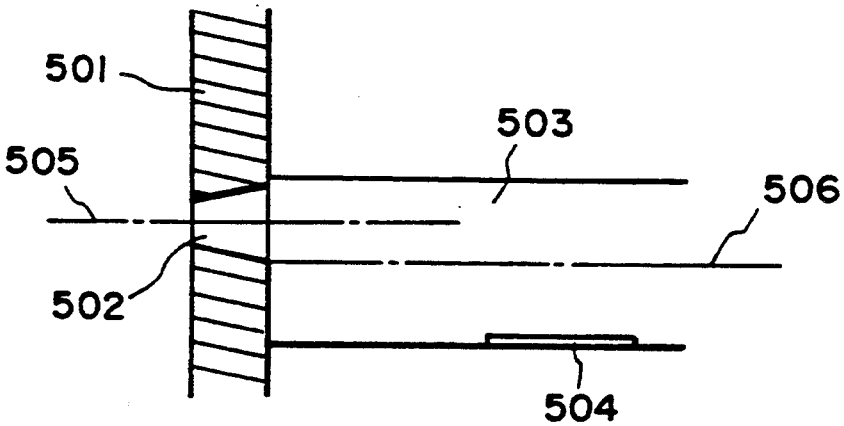
FIG. 5 illustrates the structure of a major portion of a liquid jet recording head according to a second embodiment of the present invention.
Figure 6:
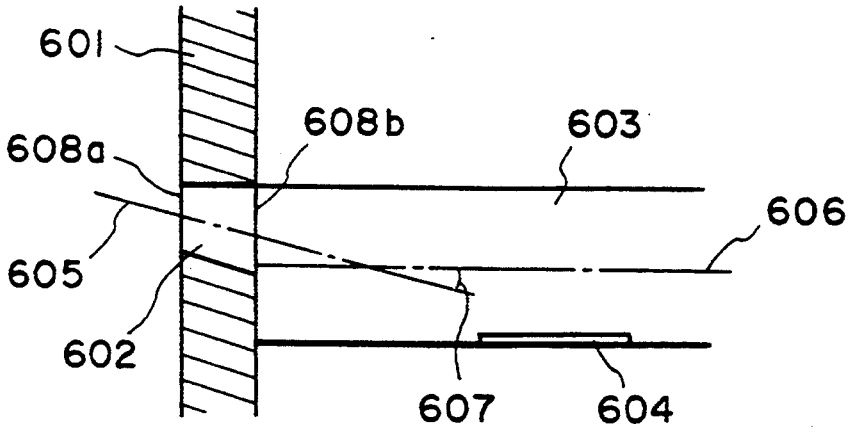
FIG. 6 illustrates the structure of a major part of the liquid jet recording head according to a third embodiment of the present invention.

FIGS. 5 and 6 show other preferred embodiments.

In FIG. 5, reference numerals 501 and 502 designate an orifice plate and a converging aperture (outlet), respectively. Reference numerals 503, 504, 505 and 506 designate an ink passage, a heat generating element in the planar form, a center line of the aperture 502 or a substantial center line thereof, and a center line of the passage, respectively.

In FIG. 6, reference numerals 601 and 602 designate an orifice plate and a converging aperture, respectively. Reference numerals 603, 604, 605, 606 and 607 designate an ink passage, a heat generating element in the form of a planar form, an orifice center line connecting the center of a front orifice 608*a* of the aperture 608*b* and the center of a rear orifice 602*b*, the center line of the ink passage, and an inclination angle between the center line 605 of the orifice and the center line 606 of the ink passage.

In either of the above embodiments, the direction of the satellite droplet ejection abuts the internal wall of the aperture 602, so that the satellite droplets are not ejected out.

In the embodiment of FIG. 5, the center line 505 of the orifice and the center line 506 of the ink passage 503 are parallel or substantially parallel, and therefore, the two center lines do not cross with each other.

Figure 7:
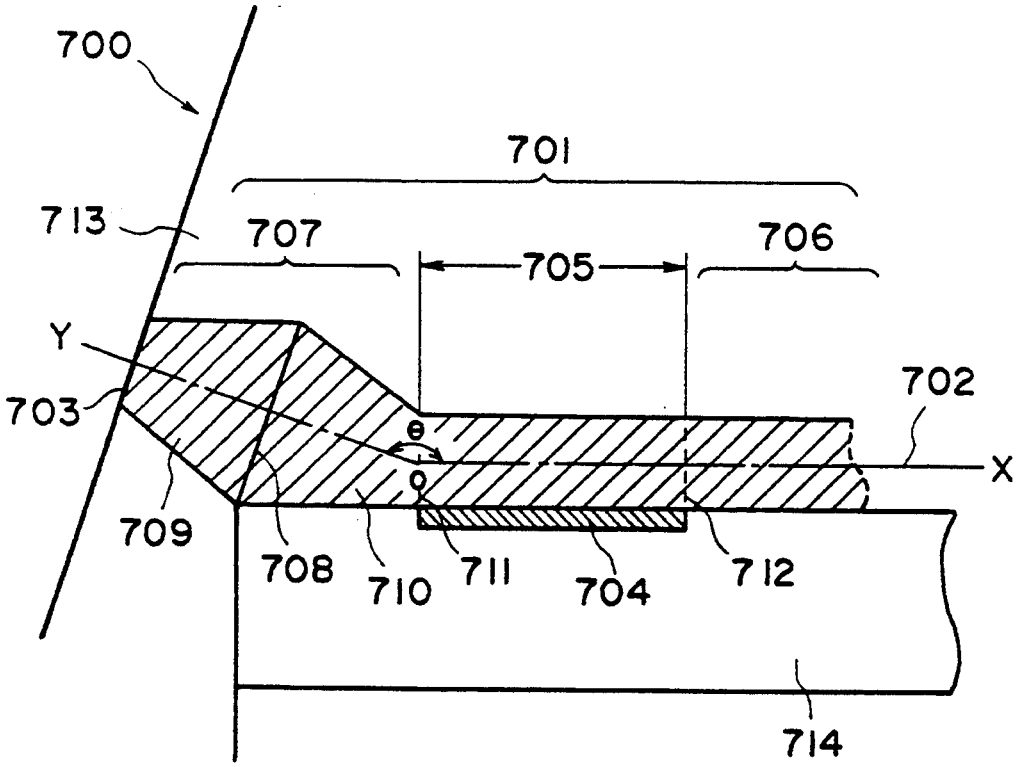
FIG. 7 illustrates a major part of the liquid jet recording head according to a fourth embodiment of the present invention.

FIG. 7 shows a major part of the ink jet recording head according to another embodiment, wherein a cross-sectional view of only one orifice is shown, but a number of orifices may be provided.

To the liquid passage 701 of the liquid jet recording head, the liquid 702 is supplied by means of a supply container (not shown), a supply pipe (not shown) and a filter (not shown) or the like.

The liquid 702 may be pressurized by proper pressure means such as pump to such an extent that the ink does not eject through the ejection orifice 703 by the pressure means alone.

The heat generating element 704 for producing thermal energy shown in this Figure is disposed in the thermal actuation portion 705. The thermal energy produced thereby acts on the liquid in the thermal actuation portion, and the liquid is instantaneously subjected to the phase change with the result of production of a bubble therein. The ejection force produced thereupon is effective to eject the droplet of liquid through the ejection orifice 703. The major part of the liquid passage 701 is constituted by a liquid supply passage 706 for supplying a proper amount of liquid to the thermal actuation portion 705 and a liquid ejection passage 707 for containing liquid to be ejected through the ejection orifice 703 by the abovedescribed ejection force produced at the thermal actuation portion 705.

In the case of the liquid jet recording head 700 shown in FIG. 7, the thermal actuation portion 705 and the liquid supply passage 706 have substantially the same internal configuration. Particularly the boundary portion between the thermal actuation portion 705 and the liquid supply passage 706 is linear, so that the liquid supply to the thermal actuation portion 705 is effected efficiently. The liquid ejection passage 707 is constituted by a front zone 709 and a rear zone 710 with the boundary of the rear orifice 708. The front zone 709 has a rotation symmetry about a center line YO passing through the center of the ejection orifice 703 and the rear orifice 708. The cross-sectional area of the passage gradually decreases from the rear orifice 708 to the ejection orifice 703.

The rear zone 710 is connected with the thermal actuation portion 705 with the boundary of the front opening 711, and the passage is gradually diverged from the front opening 711 side toward the rear orifice 708 side. In the case of the liquid jet recording head 700 of FIG. 7, the connection between the thermal actuator portion 705 and the liquid ejection passage 707 is such that the center line YO passes through the center O of the front opening 711.

The thermal actuator portion 705 and the liquid supply passage 706 has a common center line XO, and the configurations of the cross-section thereof across the center line XO are substantially the same.

In the case of the liquid jet recording head 700 shown in FIG. 7, an angle $\theta$ is formed between the center line YO and the center line XO which passes through the center of the front opening 711 and the center of the rear opening 712, the center lines are crossed at the point 0. The liquid passage 701 is structured such that the center line XO abuts the internal wall in the front zone 709 of the liquid ejection passage 707. The liquid passage 701 is defined by a block 713 having a groove providing the liquid passage and a heater board 714 having the heat generating element 704. The angle $\theta$ can be properly determined by one skilled in the art in connection with the other parameters so as to accomplish the object of the present invention. In this invention, the angle $\theta$ is preferably not less than 90 degrees but less than 180 degrees, further preferably not less than 135 degrees and not more than 177 degrees. In the embodiment of FIG. 7, the liquid ejection passage 707 is defined by an opening constituting the front zone 709 of the liquid ejection portion 707, a block 713 having a groove constituting the liquid passage and a heater board 714 provided with the heat generating element 704. The bottom surface of the rear zone 710 continues from the surface of the heat generating element 704 so as to make smooth the flow of the liquid into the thermal actuator portion 704.

Thus, it will be recognized that the liquid supply passage 706 (here, including the thermal actuation portion 705) and rear zone (diverging portion) 710 are constructed so as to have a common collinear surface substantially parallel to the second center line X-O. Such structure is readily apparent as the bottom wall in the rear zone 710 and at front opening 711.

The rear zone 710 has a configuration in which the sectional area across the center line YO gradually increases toward the ejection orifice 703 side, and therefore, the resistance against the flow by the passage is small in the rear zone 710, and therefore, the ejection efficiency is increased.

In the front zone 709, the sectional area across the center line YO gradually decreases toward the ejection orifice 703, and therefore, the quantity of ejection can be made proper, and the ejection speed can be increased.

Figure 8:
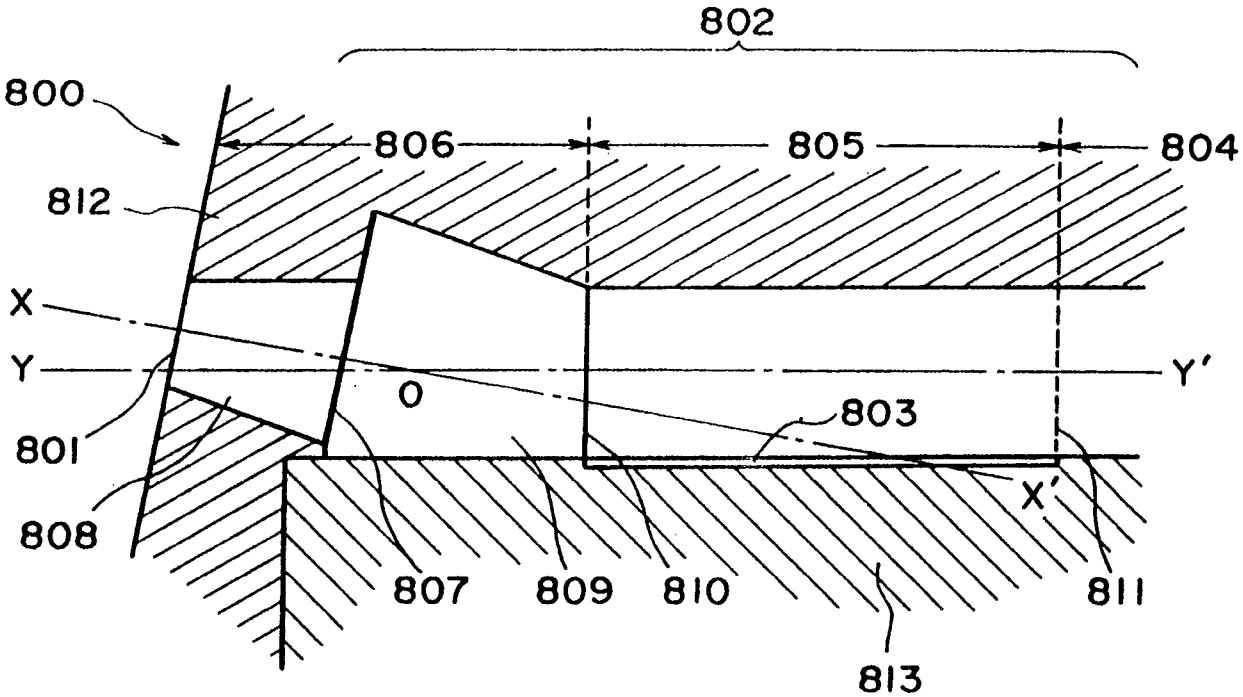
FIG. 8 illustrates the structure of a major part of the liquid jet recording head according to a fifth embodiment of the present invention.

FIG. 8 shows a major part of an ink jet recording head according to a further embodiment of the present invention. The liquid jet recording head 800 shown in FIG. 8 is provided with a liquid passage 802 having an ejection orifice 801 at its end and a heat generating resistor 803 disposed along the passage 802.

The liquid passage 802 is mainly constituted by a liquid supply passage 802 (FIG. 8 shows only a part thereof), a thermal actuator portion 805 and a liquid ejection passage 806. The liquid ejection passage 803 is constituted by a front zone 808 and a rear zone 809 with the boundary of rear orifice 807. A center line XX' connecting the center of the ejection orifice 801 and the center of the rear orifice 807 crosses with a center line YY' passing through the center of the front opening 810 and a center of the rear opening 811, at a point 0 in the rear zone 809.

In the case of the liquid jet recording head 800 shown in FIG. 8, as contrasted to the case of the liquid jet recording head 700 shown in FIG. 7, the center line YY' does not cross the internal wall in the front zone 808, but passes through the ejection orifice 801. The liquid passage 802 is so constructed.

The front zone 808 is gradually diverging from the ejection orifice 801 side toward the rear orifice 807 side, and is connected with the rear zone 809 at the position of the rear orifice 807. At the position of the rear orifice 807, the area of the opening in the rear zone is sufficiently large relative to the opening area in the front zone. In other words, the configurations of the front zone 808 and the rear zone 809 are so designed that the volume of the rear zone 809 is sufficiently large relative to the volume of the front zone 808. The passage 802 is defined by a block having an opening (front zone 808) and having a groove constituting the rear zone 809, the thermal actuator portion 805 and the liquid supply passage 804 and by a heater board 813 provided with a heat generating resistor 803 formed through a semi-conductor manufacturing process.

Thus, it will be recognized that, as shown in FIG. 8, the liquid supply passage 804 (here, including the thermal actuator portion 805) and rear zone (diverging portion) 809 are constructed so as to have a common collinear surface substantially parallel to the second center line Y'-O. Such structure is readily apparent at the bottom wall of the rear zone (diverging portion) 809 and at front opening 810.

In the case of the liquid jet recording head shown in FIG. 8, the configuration of the front zone 808, the inclination of the center line XX' relative to the heat generating resistor 803 surface and the thermal actuator portion 805 are designed such that the center XX' is across a surface of the heat generating resistor 803. In addition, the volume of the rear zone 809 is made sufficiently large, and therefore, the ejection efficiency is significantly improved over the conventional structure, and in addition, the direction of the ejection is stabilized, and the ejection speed is increased.

In the junction between the block 812 and the heater board 813, there is a junction recess. By this, even if the block 812 is slight warped due to the thermal deformation, or even if the accuracy in the cutting of the junction surface of the heater board 813, the object of the present invention is effectively accomplished. In addition, even if a gap is produced at the junction due to the difference in the thermal expansion coefficient between the block 812 and the heater board 813, cross talk between the adjacent passages can be prevented.

FIGS. 9, 10, 11, 12 and 13 illustrate an ink jet unit IJU, an ink jet heat IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 9:
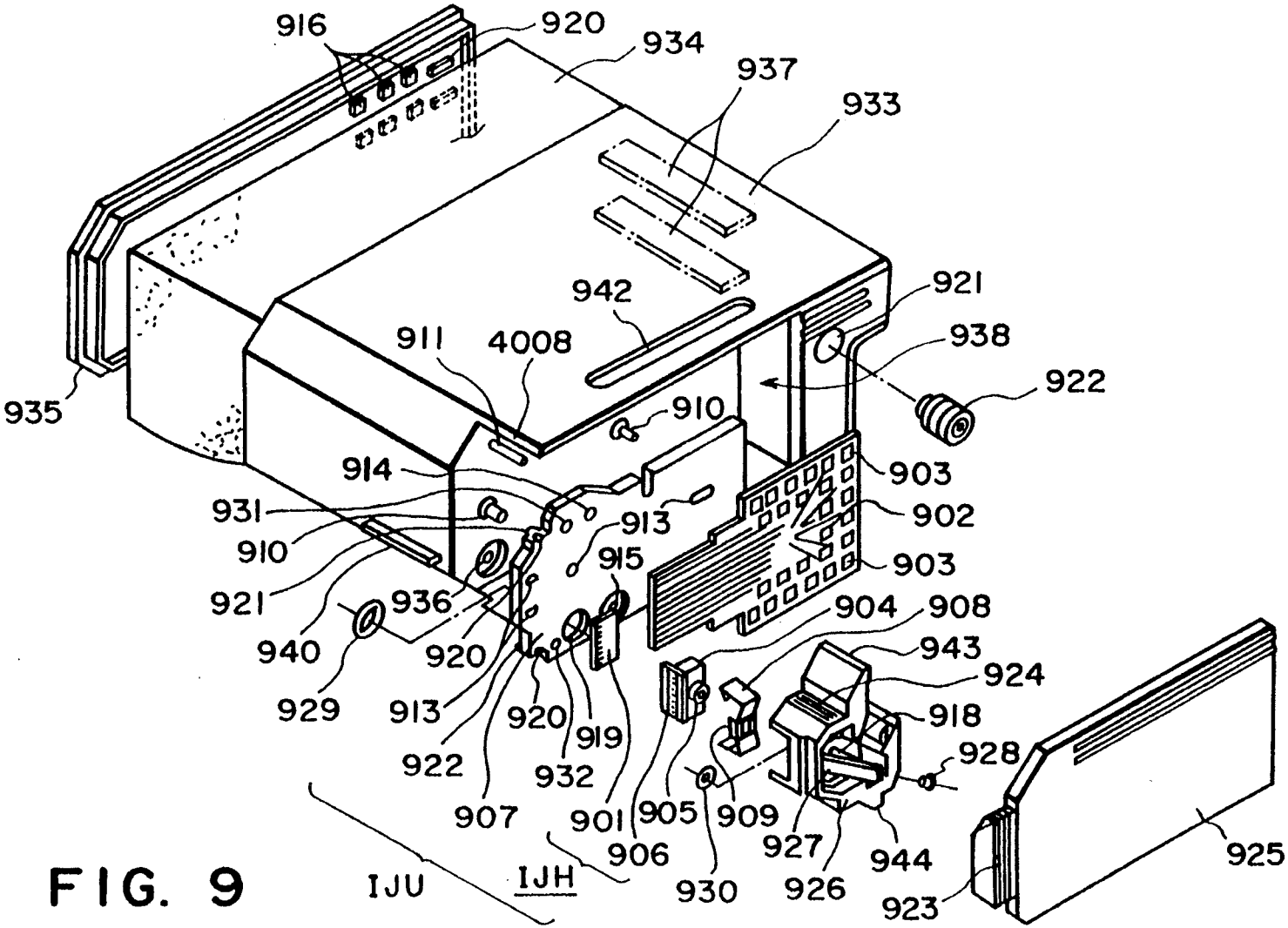
FIGS. 9, 10, 11, 12 and 13 show ink jet cartridges and recording apparatuses using the liquid jet recording heads of FIGS. 4, 5, 6, 7 and 8, respectively.
Figure 10:
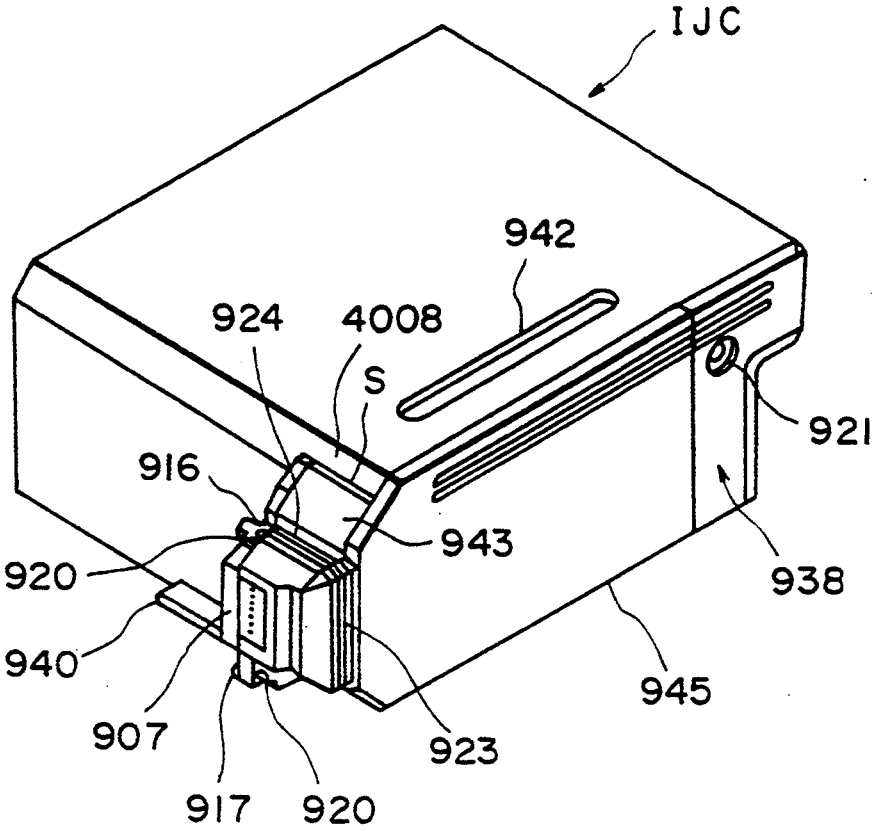

As will be understood from the perspective view of FIG. 10, the ink jet cartridge IJC in this embodiment has a relatively large ink accommodation space, and an end portion of the ink jet unit IJU is slightly projected from the front side surface of the ink container IT. The ink jet cartridge IJC is mountable at the correct position on the carriage HC (FIG. 12) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 9–13 contain various novel features, which will first be described generally.

(i) Ink jet Unit IJU

The ink jet unit IJU is of a bubble jet recording type using electrothermal transducers which generate thermal energy, in response to electric signals, to produce film boiling of the ink.

Referring to FIG. 9, the unit comprises a heater board 901 having electrothermal transducers (ejection heaters) arranged in a line on an Si substrate and electric lead lines made of aluminum or the like to supply electric power thereto. The electrothermal transducer and the electric leads are formed by a film forming process. A wiring board 902 is associated with the heater board 901 and includes wiring corresponding to the wiring of the heater board 901 (connected by the wire bonding technique, for example) and pads 903 disposed at an end of the wiring to receive electric signals from the main assembly of the recording apparatus.

A top plate 904 is provided with grooves which define partition walls for separating adjacent ink passages and a common liquid chamber for accommodating the ink to be supplied to the respective ink passages. The top plate 904 is formed integrally with an ink jet opening 905 for receiving the ink supplied from the ink container IT and directing the ink to the common chamber, and also with an orifice plate 906 having the plurality of ejection outlets corresponding to the ink passages. The material of the integral mold is preferably polysulfone, but may be another molding resin material.

A supporting member 907 is made of metal, for example, and functions to support a backside of the wiring board 902 in a plane, and constitutes a bottom plate of the ink jet unit IJU. A confining spring 908 is in the form of "M" having a central portion urging to the common chamber with a light pressure, and a clamp 909 urges concentratedly with a line pressure to a part of the liquid passage, preferably the part in the neighborhood of the ejection outlets. The confining spring 908 has legs for clamping the heater board 901 and the top plate 904 by penetrating through the openings 913 of the supporting plate 907 and engaging the back surface of the supporting plate 907. Thus, the heater board 901 and the top plate 907 are clamped by the concentrated urging force by the legs and the clamp 909 of the spring 908. The supporting plate 907 has positioning openings 913, 914 and 915 engageable with two positioning projections 910 and positioning and fuse-fixing projections 911 and 912 of the ink container IT. It further includes projections 916 and 917 at its backside for the positioning relative to the carriage HC of the main assembly IJRA.

In addition, the supporting member 907 has a hole 320 through which an ink supply pipe 918, which will be described hereinafter, is penetrated for supplying ink from the ink container. The wiring board 902 is mounted on the supporting member 907 by bonding agent or the like. The supporting member 907 is provided with recesses 920 and 920 adjacent the positioning projections 917 and 917.

Figure 12:
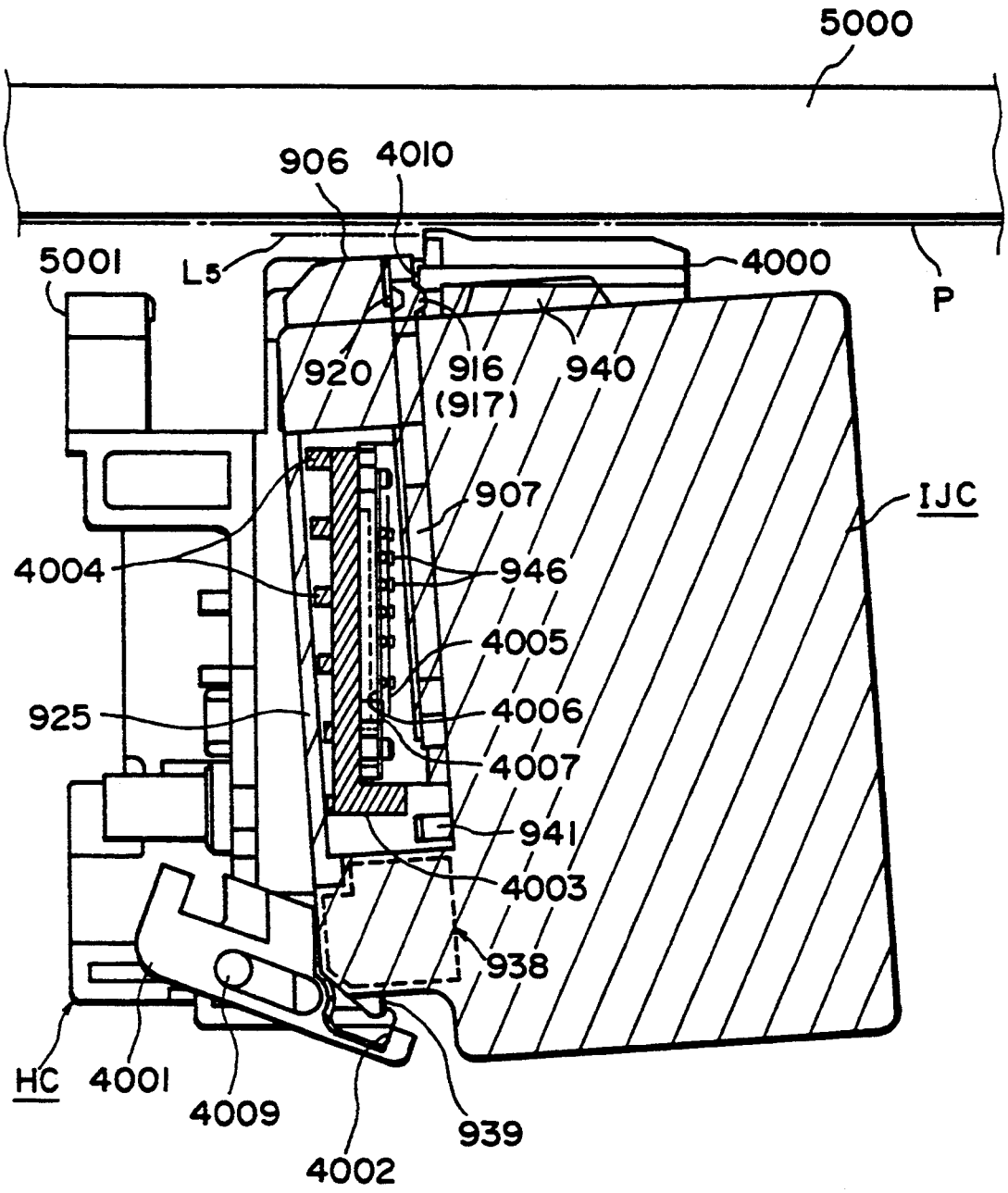

As shown in FIG. 10, the assembled ink jet cartridge IJC has a head projected portion having three sides provided with plural parallel grooves 923 and 924. The recesses 920 and 920 are located at extensions of the parallel grooves at the top and bottom sides to prevent the ink or foreign matter moving along the groove from reaching the projections 916 and 917. The covering member 925 having the parallel grooves 923, as shown in FIG. 12, constitutes an outer casing of the ink jet cartridge IJC and cooperates with the ink container to define a space for accommodating the ink jet unit IJU. The ink supply member 926 having the parallel groove 924 has an ink conduit pipe 927 communicating with the abovedescribed ink supply pipe 918 and cantilevered at the supply pipe 918 side. In order to assure the capillary action at the fixed side of the ink conduit pipe 927 and the ink supply pipe 918, a sealing pin 928 is inserted.

A gasket 929 seals the connecting portion between the ink container IT and the supply pipe 918. A filter 930 is disposed at the container side end of the supply pipe. The ink-supply member 926 is molded, and therefore, it is produced at low cost with high positional accuracy. In addition, the cantilevered structure of the conduit 927 assures the press-contact between the conduit 927 and the ink inlet 905 even if the ink supply member 926 is mass-produced.

In this embodiment, the complete communicating state can be assuredly obtained simply by flowing sealing bonding agent from the ink supply member side under the press-contact state. The ink supply member 926 may be fixed to the supporting member 907 by inserting and penetrating backside pins (not shown) of the ink supply member 926 through the openings 931 and 932 of the supporting member 907 and by heat-fusing the portion where the pins are projected through the backside of the supporting member 907. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 933, an ink absorbing material and a cover member 935. The ink absorbing material 934 is inserted into the main body 933 from the side opposite from the unit (IJU) mounting side, and thereafter, the cover member 935 seals the main body.

The ink absorbing material 934 is thus disposed in the main body 933. The ink supply port 936 functions to supply the ink to the ink jet unit IJU comprising the above-described parts 901–906, and also functions as an ink injection inlet to permit initial ink supply to the absorbing material 901 before the unit IJU is mounted to the portion 935 of the main body.

In this embodiment, the ink may be supplied through an air vent port and this supply opening. In order to ensure good supply of ink, ribs 937 are formed on the inside surface of the main body 933, and ribs 916 and 920 are formed on the inside of the cover member 935, which are effective to provide within the ink container an ink existing region extending continuously from the air vent port side to that corner portion of the main body which is most remote from the ink supply opening 936. Therefore, in order to uniformly distribute the ink, it is preferable that the ink is supplied through the supply opening 936. This ink supply method is practically effective. The number of the ribs 937 in this embodiment is four, and the ribs 937 extend parallel to a movement direction of the carriage adjacent the rear side of the main body of the ink container, by which the absorbing material 934 is prevented from closely contacting to the inner surface of the rear side of the main body. The ribs 916 and 920 are formed on the inside surface of the cover member 935 at a position which is substantially an extension of the ribs 937, however, as contrasted to the large rib 937, the size of the ribs 916 and 920 are small as if it is divided ribs, so that the air existing space is larger with the ribs 916 and 920 than with the rib 937. The ribs 916 and 920 are distributed on the entire area of the cover member 935, and the area thereof is not more than one half of the total area. Because of the ribs, the ink in the corner region of the ink absorbing material which is most remote from the supply opening 926 can be stably and assuredly supplied to the inlet opening by capillary action. The cartridge is provided with an air vent port for communication between the inside of the cartridge with the outside air. Inside the vent port 922, there is a water repellent material 922 to prevent the inside ink from leaking outside through the vent port 922.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 935 to stabilize the ink supply from the ink absorbing material 933. The cube configuration is preferable from the standpoint of accommodating as much ink as possible in limited space. However, from the standpoint of using the ink with the minimum available parts in the ink container, the the ribs are formed on the two surfaces constituting a corner.

In this embodiment, the inside ribs 916 and 920 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 936 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of cartridge exchanges is minimized. Utilizing the rear space of the space used for unifying the ink jet unit IJU, there is a projection for the air vent port 921. The inside of the projection is substantially vacant, and the vacant space 938 functions to supply the air into the ink container IT uniformly in the direction of the thickness of the absorbing material. Because of these features described above, the cartridge as a whole is of better performance than the conventional cartridge. The air supply space 938 is much larger than that in the conventional cartridge. In addition, the air vent port 921 is at an upper position, and therefore, if the ink departs from the absorbing material for some reason or another, the air supply space 938 can tentatively retain the ink to permit such ink to be absorbed back into the absorbing material. Therefore, the wasteful consumption of the ink can be saved.

Figure 11:
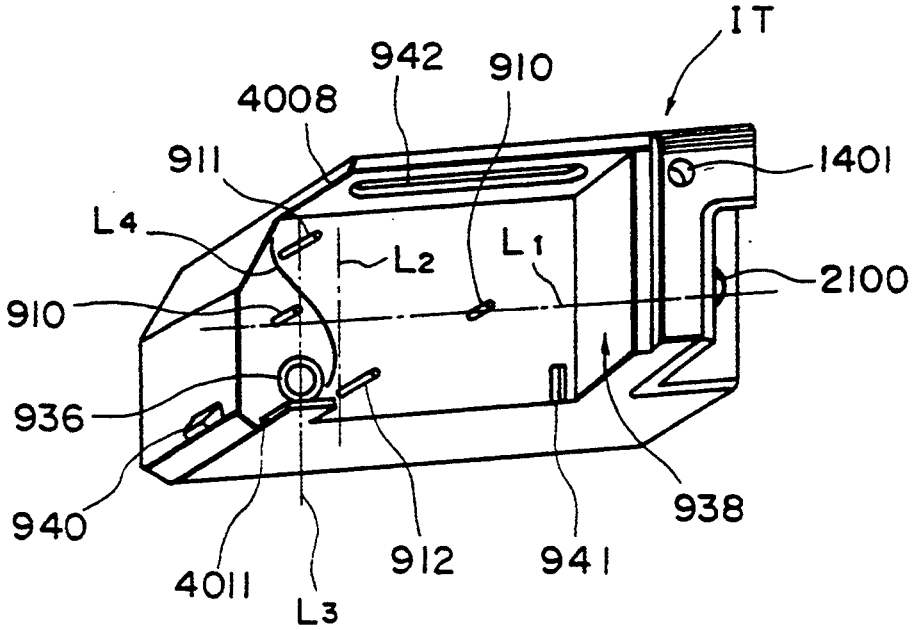

Referring to FIG. 11, there is shown a structure of a surface of the ink container IT to which the unit IJU is mounted. Two positioning projections 910 are on a line L1 which is a line passing through the substantial center of the array of the ejection outlets in the orifice plate 906 and parallel with the bottom surface of the ink container IT or the parallel to the ink container supporting reference surface of the carriage. The height of the projections 910 is slightly smaller than the thickness of the supporting member 907, and the projections 910 function to correctly position the supporting member 907. On an extension (right side) in this Figure, there is a pawl 939 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 12.

Projections 911 and 912, corresponding to the fixing holes 914 and 915 for fixing the supporting member 907 to the side of the ink container IT, are longer than the projections 910, so that they penetrate through the supporting member 907, and the projected portions are fused to fix-the supporting member 907 to the side surface. A line L3 passing through the projection 911 and perpendicular to the line L1, and a line L2 passing through the projection 912 and perpendicular to the line L1, are drawn. The center of the supply opening 936 is substantially on the line L3, the connection between the supply opening 936 and a supply type 918 is stabilized, and therefore, even if the cartridge falls, or even if a shock is imparted to the cartridge, the force applied to the connecting portion can be minimized. In addition, since the lines L2 and L3 are not overlapped, and since the projections 911 and 912 are disposed adjacent to that projection 910 which is nearer to the ink ejection outlets of the ink jet head, the positioning of the ink jet unit relative to the ink container is further improved. In this Figure, a curve L4 indicates the position of the outer wall of the ink supply member 926 when it is mounted. Since the projections 911 and 912 are along the curve L4, the projections are effective to provide sufficient mechanical strength and positional accuracy against the weight of the end structure of the head IJH.

An end projection 940 of the ink container IT is engageable with a hole formed in the front plate 4000 of the carriage to prevent the ink cartridge from being displaced extremely out of the position. A stopper 941 is engageable with an unshown rod of the carriage HC, and when the cartridge IJC is correctly mounted with rotation, which will be described hereinafter, the stopper 941 take a position below the rod, so that even if an upward force tending to disengage the cartridge from the correct position is unnecessarily applied, the correct mounted state is maintained. The ink container IT is covered with a cover 925 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 942 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 926 through a supply opening 936, the hole 919 of the supporting member 907 and an inlet formed in the backside of the ink supply member 926. From the chamber of the ink supply member 926, the ink is supplied to the common chamber through the outlet, supply pipe and an ink inlet 905 formed in the top plate 904. The connecting portion for the ink communication is sealed by silicone rubber or butyl rubber or the like to assure the hermetical seal.

In this embodiment, the top plate 904 is made of resin material having resistivity to the ink, such as polysulfone, polyether sulfone, polyphenylene oxide, polypropylene. It is integrally molded in a mold together with an orifice plate portion 906.

As described in the foregoing, the integral part comprises the ink supply member 926, the top plate 904, the orifice plate 906 and parts integral therewith, and the ink container body 933. Therefore, the accuracy in the assembling is improved, and is convenient in the mass-production. The number of parts is smaller than inconventional device, so that the good performance can be assured.

In this embodiment, as shown in FIGS. 9–11, the configuration after assembly is such that the top portion 943 of the ink supply member 926 cooperates with an end of the top thereof having the slits 942, so as to form a slit S, as shown in FIG. 10. The bottom portion 944 cooperates with fed side end 4011 of a thin plate to which the bottom cover 925 of the ink container IT is bonded, so as to form a slit (not shown) similar to the slit S. The slits between the ink container IT and the ink supply member 926 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined each other.

(iii) Mounting of the Ink jet Cartridge IJC to the Carriage HC

In FIG. 12, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 906 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 946 corresponding to the pads 903 of the wiring board 902 of the ink jet cartridge IJC and a rubber pad sheet 4007 for producing elastic force for urging the backside of the flexible sheet 4005 to the pads 903. The positioning hook 4001 functions to fix the ink jet cartridge IJC to the recording position. The front plate 4000 is provided with two positioning projection surfaces 4010 corresponding to the positioning projections 916 and 917 of the supporting member 907 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decreases from the plate roller side to the hook 4001 side. By this, the cartridge is inclined as shown in FIG. 12, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 946 is determined. When the cartridge IJC is fixed at the recording position, the positioning surfaces are brought into contact with the surface of the supporting member 907. In this embodiment, the pads 903 of the supporting member 907 are distributed so that they are symmetrical with respect to the above-described line L1, and therefore, the amount of deformation of the respective projections of the rubber sheet 4007 are made uniform to stabilize the contact pressure of the pads 946 and 903. In this embodiment, the pads 903 are arranged in two columns and upper and bottom two rows.

The hook 4001 is provided with an elongated hole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 12 to the position toward the platen side, and the positioning projections 916 and 917 come to the position where they are engageable to the positioning surfaces 4010. Then, the hook 4001 is moved leftwardly, so that the hook surface 4002 is contacted to the pawl 939 of the cartridge IJC, and the ink cartridge IJC rotates about the contact between the positioning surface 916 and the positioning projection 4010 in a horizontal plane, so that the pads 903 and 946 are contacted to each other. When the hook 4001 is locked, that is retained at the fixing or locking position, by which the complete contacts are simultaneously established between the pads 903 and 946, between the positioning portions 916 and 4010, between the standing surface 4002 and the standing surface of the pawl and between the supporting member 907 and the positioning surface 4006, and therefore, the cartridge IJC is completely mounted on the carriage.

(iv) General Arrangement of the Apparatus

Figure 13:
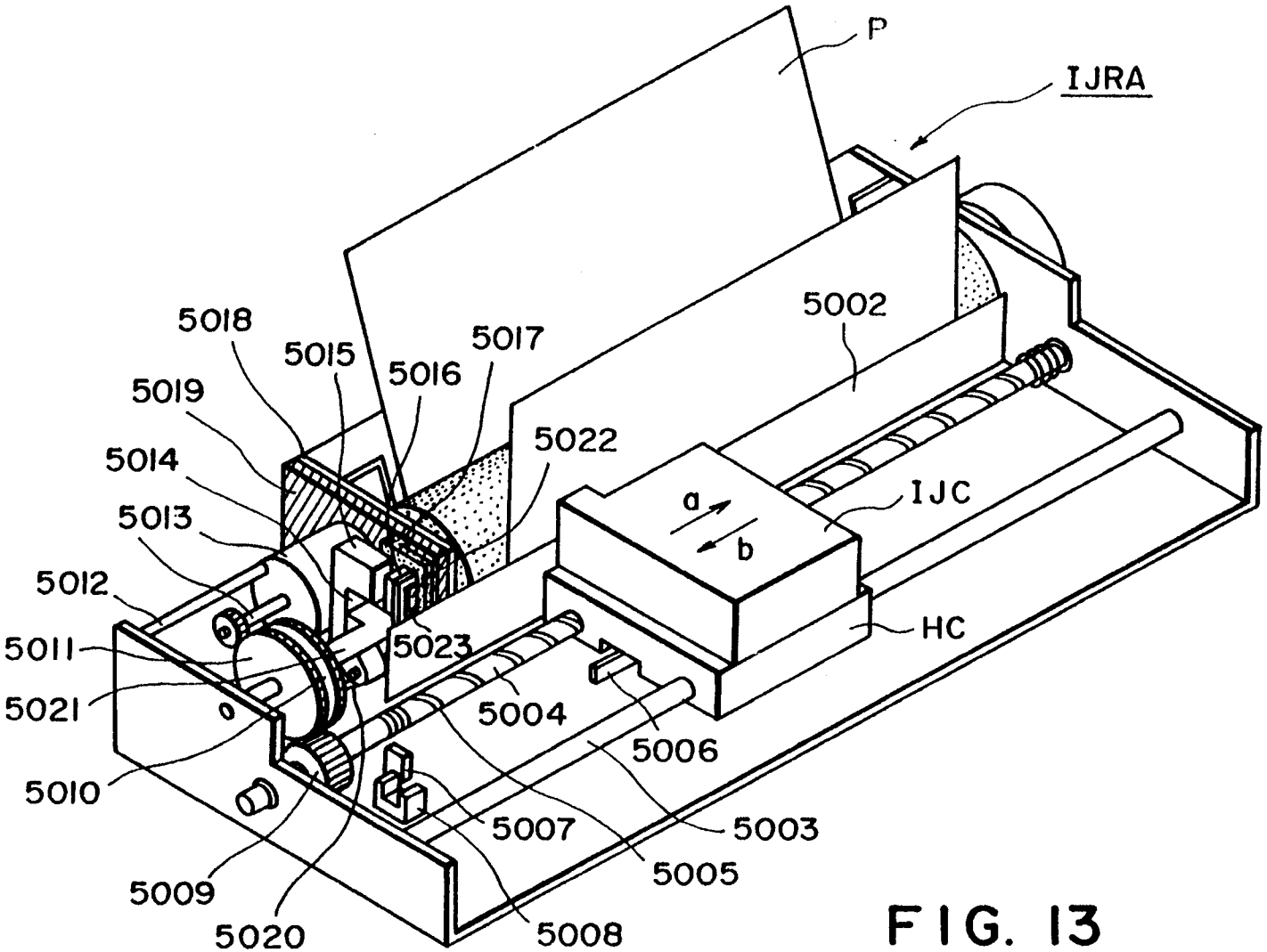

FIG. 13 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

As described in the foregoing, according to the present invention, the liquid passage structure leads to an ink jet recording head and an ink jet recording apparatus having a high ejection efficiency without satellite printing, so that a high quality printing is possible.

In addition, the number of parts is reduced, so that the structure becomes simplified, and the manufacturing is easy. Particularly, the productivity is remarkably improved in the case of mass-production to provide a high density multi-orifice type head and apparatus.

According to an embodiment of the present invention, a wall portion is deliberately disposed across the liquid passage of the satellite droplet to prevent or impede the satellite droplet from ejecting out of the recording head, so that the satellite droplet printing is prevented or reduced.

By the elimination or reduction of the satellite droplet, the edge of a printed character or image can be made surface, and the ink jet recording head of high resolution and high speed can be provided.

In addition, the satellite droplet returns into the liquid passage, and therefore, the ink consumption can be reduced. Assuming that the quantity of satellite droplet is 0.6 pl relative to a main droplet of 60 pl, 1% of ink consumption can be saved.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the abovementioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. it may be, however, an ink material solidified atthe room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A liquid jet comprising:

heat generating means for producing a bubble to eject liquid from the head;

a heat acting zone in which heat generated by said heat generating means produces a bubble in the liquid;

a liquid supply passage adjacent said heat acting zone and having a liquid supply opening, with a center, for supplying liquid to said heat acting zone; and a liquid ejection passage adjacent said heat acting zone and having an orifice, with a center, through which the liquid is ejected, said liquid ejection passage including a diverging portion extending in a direction from said heat acting zone toward said orifice;

wherein a first plane including a first center line passing through said center of said orifice and along a direction of liquid ejection through said orifice, and a second plane including a second center line passing through said center of said liquid supply opening and along a direction of the supply of liquid from said liquid supply passage to said heat acting zone, cross in said diverging portion of said liquid ejection passage, and wherein at least a portion of said liquid supply passage and at least a portion of said diverging portion have a common, collinear surface substantially parallel to said second center line.

2. A liquid jet head according to claim 1, wherein said second center line crosses a wall of said liquid ejection passage.

3. A liquid jet head according to claim 1, wherein said liquid ejection passage further includes a converging portion extending from said diverging portion toward said orifice.

4. A liquid jet head according to claim 1, wherein said second center line passes through said orifice offset from said center thereof.

5. A liquid jet apparatus comprising:

a liquid jet head comprising:

heat generating means for producing a bubble to eject liquid from said head;

a heat acting zone in which heat generated by said heat generating means produces a bubble in the liquid;

a liquid supply passage adjacent to said heat acting zone and having a liquid supply opening, with a center, for supplying liquid to said heat acting zone;

a liquid ejection passage adjacent said heat acting zone and having an orifice, with a center, through which the liquid is ejected, said liquid ejection passage including a diverging portion extending in a direction from said heat acting zone toward said orifice;

wherein a first plane including a first center line passing through said center of said orifice and along a direction of liquid ejection through said orifice, and a second plane including a second center line passing through said center of said liquid supply opening and along a direction of the supply of liquid from said liquid supply passage to said heat acting zone, cross in said diverging portion of said liquid ejection passage, and wherein at least a portion of said liquid supply passage and at least a portion of said diverging portion have a common, collinear surface substantially parallel to said second center line.

6. A liquid jet apparatus to claim 5, wherein said second center line crosses a wall of said liquid ejection passage.

7. A liquid jet apparatus according to claim 5, wherein said liquid ejection passage further includes a converging portion extending from said diverging portion toward said orifice.

8. A liquid jet apparatus according to claim 5, wherein said second center line passes through said orifice offset from said center thereof.

9. A liquid set cartridge comprising:

heat generating means for producing a bubble to eject liquid from the cartridge;

a heat acting zone in which heat generated by said heat generating means produces a bubble in the liquid;

a liquid supply passage adjacent said heat acting zone and having a liquid supply opening, with a center, for supplying liquid to said heat acting zone; and a liquid ejection passage adjacent said heat acting zone and having an orifice, with a center, through which the liquid is ejected, said liquid ejection passage including a diverging portion extending in a direction from said heat acting zone toward said orifice;

wherein a first plane including a first center line passing through said center of said orifice and along a direction of liquid ejection through said orifice, and a second plane including a second center line passing through said center of said liquid supply opening and along a direction of the supply of liquid from said liquid supply passage to said heat acting zone, cross in said diverging portion of said liquid ejection passage, and wherein at least a portion of said liquid supply passage and at least a portion of said diverging portion have a common, collinear surface substantially parallel to said second center line.

10. A liquid jet cartridge according to claim 9, wherein said second center line crosses a wall of said liquid ejection passage.

11. A liquid jet cartridge according to claim 9, wherein said liquid ejection passage further includes a converging portion extending from said diverging portion toward said orifice.

12. A liquid jet cartridge according to claim 9, wherein said second center line passes through said orifice offset from said center thereof.

13. A liquid jet cartridge, comprising:

a heat generating means for producing a bubble to eject liquid from the cartridge;

a heat acting zone which is filled with the liquid and in which heat generated by said heat generating means produces a bubble in the liquid;

a liquid supply passage adjacent said heat acting zone and having a liquid supply opening, with a center, for supplying liquid to said heat acting zone; and a liquid ejection passage adjacent said heat acting zone and having an orifice, with a center, through which the liquid is ejected, said liquid ejection passage including a diverging portion extending in a direction from said heat acting zone toward said orifice;

wherein a first plane including a first center line passing through said center of said orifice and along a direction of liquid ejection through said orifice, and a second plane including a second center line passing through said center of said liquid supply opening and along a direction of the supply of the liquid from said liquid supply passage to said heat acting zone, cross in said diverging portion of said liquid ejection passage, and wherein at least a portion of said liquid supply passage and at least a portion of said diverging portion have a common, collinear surface substantially parallel to said second center line.

* * * * *

UNITED STATES PATENT AND TRADEMARK OFFICE

CERTIFICATE OF CORRECTION

PATENT NO. : 5,371,528

DATED : December 6, 1994

INVENTORS : MASAAKI IZUMIDA, ET AL.

It is certified that error appears in the above-identified patent and that said Letters Patent is hereby corrected as shown below:

ON THE TITLE PAGE

At [54] Title

"DEVERGING" should read --DIVERGING--.

COLUMN 1

Line 2, "JET" should read --JET HEAD--.
Line 3, "DEVERGING" should read --DIVERGING--.
Line 28, "the" should be deleted.

COLUMN 2

Line 44, "line." should read --line--.

COLUMN 4

Line 39, "heat" should read --head--.
Line 58, "leas" should read --least--.

COLUMN 5

Line 59, "orifice in" should read --orifice 403a in--.
Line 60, "403a" should be deleted.

UNITED STATES PATENT AND TRADEMARK OFFICE

CERTIFICATE OF CORRECTION

PATENT NO. : 5,371,528

DATED : December 6, 1994

INVENTORS : MASAAKI IZUMIDA, ET AL.

It is certified that error appears in the above-identified patent and that said Letters Patent is hereby corrected as shown below:

COLUMN 6

Line 67, "608*b*" should read --602--.
Line 68, "602b," should read --608*b*,--.

COLUMN 7

Line 64, "has" should read --have--.

COLUMN 9

Line 16, "portion 805)" should read --portion) 805--.
Line 35, "slight" should read --slightly--.
Line 44, "heat" should read --head--.

COLUMN 11

Line 23, "slight" should read --slightly--.
Line 59, "to" should be deleted.

COLUMN 12

Line 24, "the" (second occurrence) should be deleted.

COLUMN 13

Line 57, "take" should read --takes--.

UNITED STATES PATENT AND TRADEMARK OFFICE

CERTIFICATE OF CORRECTION

PATENT NO. : 5,371,528

DATED : December 6, 1994

INVENTORS : MASAAKI IZUMIDA, ET AL.

It is certified that error appears in the above-identified patent and that said Letters Patent is hereby corrected as shown below:

COLUMN 14

Line 46, "is" should read --are--.
Line 51, "combined" should read --combined with--.

COLUMN 15

Lines 19, 20, "decreases" should read --decrease--.
Line 50, "leftwardly" should read --leftward--.
Line 60, "leftwardly" should read --leftward--.

COLUMN 16

Line 10, "a" should be deleted.
Line 15, "reciprocable" should read --reciprocal--.

COLUMN 17

Line 6, "of" should read --are--.
Line 7, "one" should read --ones--.
Line 17, "provide" should read --provided--.
Line 22, "the" (first occurrence) should be deleted.
Line 64, "are" should read --is--.

COLUMN 18

Line 17, "it" should read --It--.
Line 18, "atthe" should read --at the--.
Line 29, "when it is left is used" should read --when it is left unused--.

UNITED STATES PATENT AND TRADEMARK OFFICE

CERTIFICATE OF CORRECTION

PATENT NO. : 5,371,582

DATED : December 6, 1994

INVENTORS : MASAAKI IZUMIDA, ET AL.

It is certified that error appears in the above-identified patent and that said Letters Patent is hereby corrected as shown below:

COLUMN 18 (cont'd.)

Line 57, "jet" should read --jet head--.

COLUMN 19

Line 36, "zone;" should read --zone; and--.
Line 57, "apparatus" should read --apparatus according--.

COLUMN 20

Line 1, "set" should read --jet--.

Signed and Sealed this

Fourth Day of July, 1995

Bruce Lehman

BRUCE LEHMAN

*Commissioner of Patents and Trademarks*

*Attest:*

*Attesting Officer*